US005813901A

United States Patent [19]

Kremen

[11] Patent Number: 5,813,901

[45] **Date of Patent: *Sep. 29, 1998**

[54] METHOD AND DEVICE FOR MAGNETIC-ABRASIVE MACHINING OF PARTS

[75] Inventor: Gennady Kremen, Brooklyn, N.Y.

[73] Assignee: Scientific Manufacturing Technologies Inc, Brooklyn, N.Y

[ * ] Notice: The term of this patent shall not extend beyond the expiration date of Pat. No. 5,569,061.

[21] Appl. No.: 827,159

[22] Filed: Mar. 27, 1997

[51] Int. Cl.[6] ..... B24B 1/00

[52] U.S. Cl. ..... 451/28; 451/73; 451/37

[58] Field of Search ..... 451/93, 37, 317, 451/103, 60, 36–40, 104, 106, 113, 114, 28

[56] References Cited

U.S. PATENT DOCUMENTS

| | | | |
|---|---|---|---|
| 3,695,934 | 10/1972 | Feldhaus | 451/36 |
| 4,175,930 | 11/1979 | Sakulevich et al. | 451/36 |
| 4,306,386 | 12/1981 | Sakulevich et al. | 451/36 |
| 4,821,466 | 4/1989 | Kato et al. | 451/36 |
| 4,977,707 | 12/1990 | Chachin et al. | 451/37 |
| 5,419,735 | 5/1995 | Imahashi et al. | 45/36 |
| 5,449,313 | 9/1995 | Kordonsky et al. | 451/36 |
| 5,569,061 | 10/1996 | Kremen | 451/93 |
| 5,577,948 | 11/1996 | Kordonsky et al. | 451/36 |

FOREIGN PATENT DOCUMENTS

| | | | |
|---|---|---|---|
| 402048169 | 2/1990 | Japan | 451/93 |
| 1703413 | 1/1992 | U.S.S.R. | 451/93 |

*Primary Examiner*—Timothy V. Eley
*Assistant Examiner*—Derris H. Banks
*Attorney, Agent, or Firm*—Ilya Zborovsky

[57] ABSTRACT

A device for magnetic-abrasive machining of a part has the steps of forming a magnetic field, arranging a part to be machined in the magnetic field, supplying a magnetic-abrasive powder in a machining zone toward a surface of the part to be machined, and supplying a fluid jet under pressure toward the magnetic-abrasive powder so as to move the magnetic-abrasive powder relative the surface of the part to be machined.

12 Claims, 5 Drawing Sheets

METHOD AND DEVICE FOR MAGNETIC-ABRASIVE MACHINING OF PARTS

BACKGROUND OF THE INVENTION

The present invention relates to a method and a device for magnetic-abrasive machining of parts.

Magnetic-abrasive machining of parts is generally known in the art. In this machining a magnetic field is generated, a part is placed in the magnetic field and rotated about its axis and simultaneously oscillated along its axis, and a magnetic-abrasive powder is introduced into the area of machining simultaneously with cooling liquid which is poured into the area. The main disadvantage of the inventive method and devices is a relatively low material removal rate which is lower than the material removal rate during conventional grinding with grinding tools. It is therefore desirable to increase the material removal rate.

SUMMARY OF THE INVENTION

Accordingly, it is an object of the present invention to provide a method and a device for magnetic-abrasive machining of parts, which avoids the disadvantages of the prior art.

In keeping with these objects and with others which will become apparent hereinafter, one feature of the present invention resides, briefly stated, in a method of magnetic-abrasive machining of parts, in accordance with which a magnetic field is generated, a part is introduced in the magnetic field, a magnetic-abrasive powder is introduced into a machining zone onto the part, and a fluid jet is supplied toward the magnetic-abrasive powder to move the magnetic abrasive powder relative to a surface of the part.

In accordance with another feature of present invention, a device for magnetic-abrasive machining is proposed, which has means generated a magnetic field in which a part is introduced; means for supplying a magnetic-abrasive powder to the part in a machining zone; and means for supplying a fluid jet toward the magnetic-abrasive powder to press the magnetic-abrasive powder relative to a surface of the part.

When the method is performed and the device is designed in accordance with present invention, a substantially greater material-removal rate is provided.

In accordance with a further feature of present invention, the method is performed and the device is designed so that the fluid jet only presses the magnetic-abrasive powder against a surface of the part, and/or moves it relative to the part, to increase the material removal rate.

The novel features which are considered as characteristic for he present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
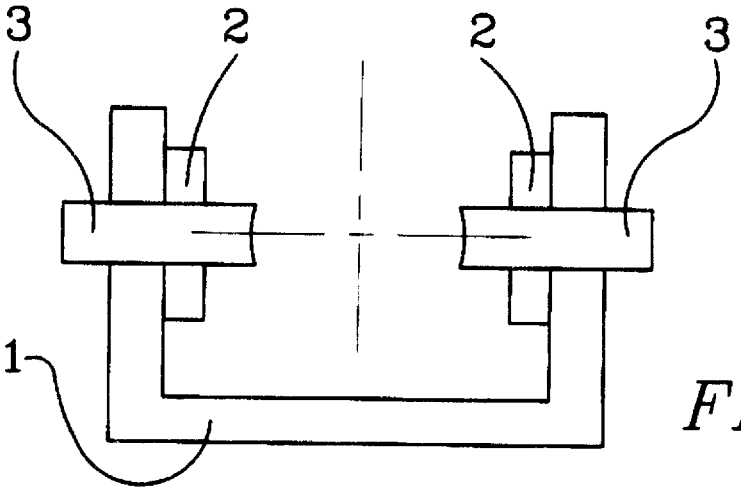
FIGS. 1*a*, 1*b*, 1*c* are views showing a successive steps during machining of a non-magnetic part with the utilization of a method and device in accordance with the present invention.
Figure 1B:
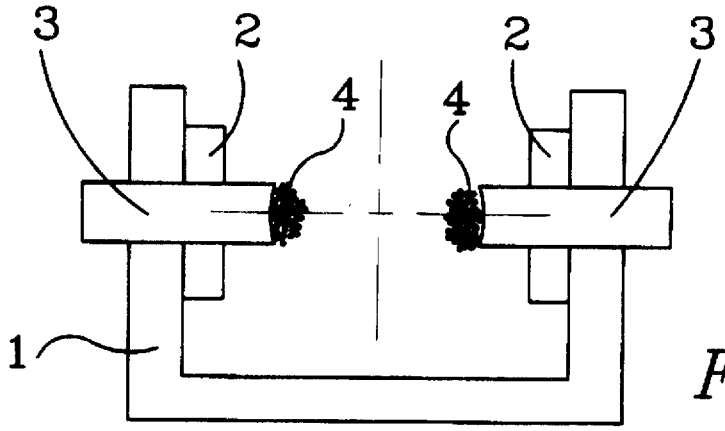
Figure 1C:
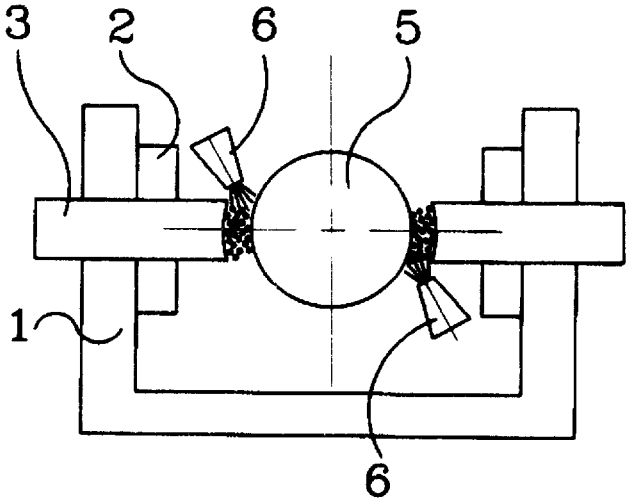

A device for magnetic-abrasive machining shown in FIGS. 1*a*–1*c* is used for example for machining of non-magnetic parts. During the machining of non-magnetic parts the powder usually does not move into a machining gap. The device has a frame 1 provided with two electromagnetic coils 2 arranged on pole shoes 3. For machining of a non-magnetic part the pole shoes 3 are first spread apart as shown in FIG. 1*a* and the electromagnetic coils 2 are not supplied with current. Then as shown in FIG. 1*b* the current is supplied to the electromagnetic coils 2 and the magnetic-abrasive powder 4 is applied on the pole shoes 3. Then a part 5 is mounted by not shown means so as to rotate about its axis and to reciprocate in direction of its axis as shown in FIG. 1*c*. The magnetic-abrasive powder 4 is retained in a machining zone by a magnetic field generated by the electromagnetic coils 2. Nozzles 6 supply a fluid jet toward the magnetic-abrasive powder 4 so as to press the magnetic-abrasive powder to a surface of the part 5. The magnetic-abrasive powder performs machining of the surface of the part. It is also possible to hold the magnetic-abrasive powder in a temporary container 7 formed for example of paper and the like as identified with reference numeral 7 in FIG. 1*c* and to arrange the container on the pole shoe. During the machining the container is destroyed and the magnetic-abrasive powder gets into a gap between the pole shoes and the part. During machining of non-magnetic and magnetic parts, the fluid jet supplied by the nozzle 6 additionally increases the action of the powder on the surface of the part and therefore in both instances the material removal rate is increased.

As shown in FIG. 1*c*, the nozzles are arranged so that the direction of the fluid jet is substantially radial with respect to the center of rotation of the part, and therefore the fluid jet performs the pressing of the magnetic-abrasive powder toward the surface of the part.

Figure 2:
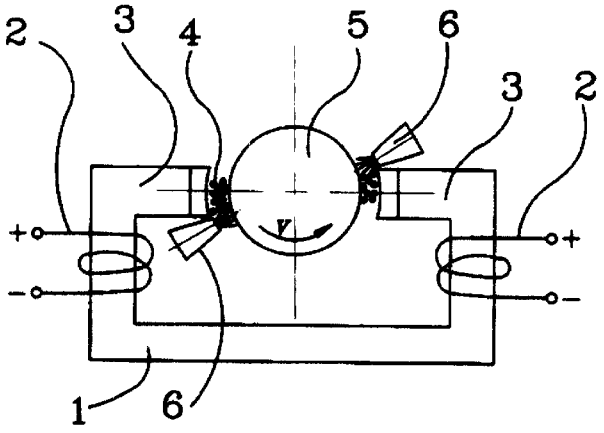
FIGS. 2–8 are views showing several embodiments of the device for magnetic-abrasive machining in accordance with present invention.

FIG. 2 shows a device for machining of outer cylindrical surfaces with the opposite arrangement of the pole shoes and the temporary containers 7 arranged on the ends of the pole shoes, while the electromagnetic coils 2 are arranged on the vertical legs of the frame 1.

Figure 3:
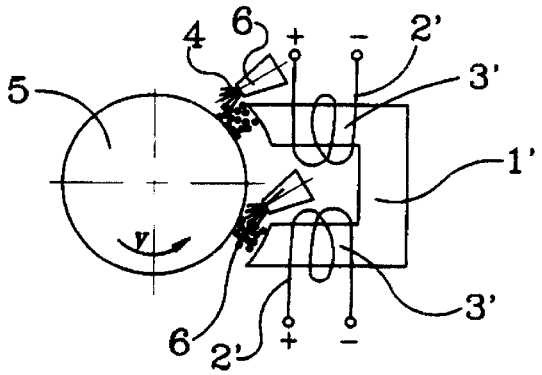

In the device shown in FIG. 3 both pole shoes 3' are arranged on one side of the part 5 and are circumferentially offset relative to one another. The electromagnetic coils 2' are arranged on both horizontal legs of the frame 1'.

Figure 4:
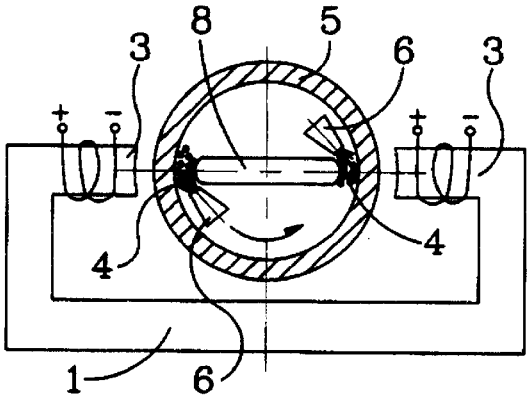

FIG. 4 shows a device for machining of inner cylindrical surfaces of parts. Here the device has an insert 8, so that a magnetic field is formed between the pole shoes 3 and the insert 8. The magnetic-abrasive powder 4 is introduced into gaps between the opposite ends of the insert 8 between both ends of the insert 8 and an inner surface of the part 5 to be machined. The nozzles 6 are arranged inside the part 5 to be machined.

Figure 5:
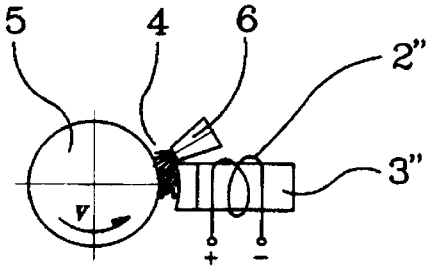

FIG. 5 shows a device for machining a part with a single pole shoe 2" and a single electromagnetic coil 3" arranged on the pole shoe. The single nozzle 6 supplies the fluid jet toward the magnetic-abrasive powder to press it to the part 5 to be machined.

Figure 6:
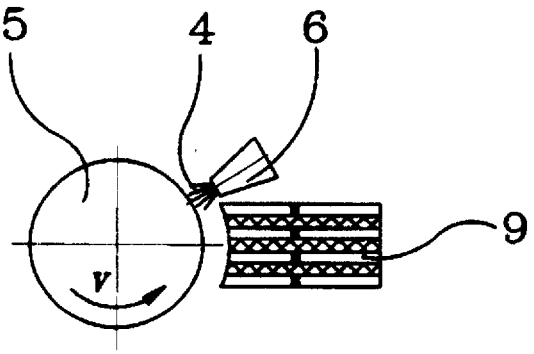

The device shown in FIG. 6 is used for machining of the part 5 and has means for forming a magnetic field, which means is composed of permanent magnets 9. The permanent magnets 9 have alternating poles and are located at one side of the part to be machined.

Figure 7:
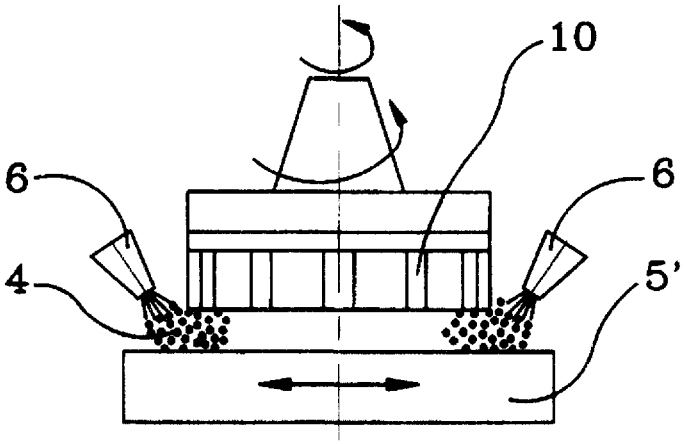

FIG. 7 shows a device in accordance with the present invention for machining of surfaces. Here a part 5' is a flat part having an upper surface to be machined. The device has means for forming a magnetic field, which can be composed of electromagnets or permanent magnets 10. The electromagnets or permanent magnets are rotatable about a substantial vertical axis, while the part 5' is reciprocatable in the horizontal plane.

Figure 8:
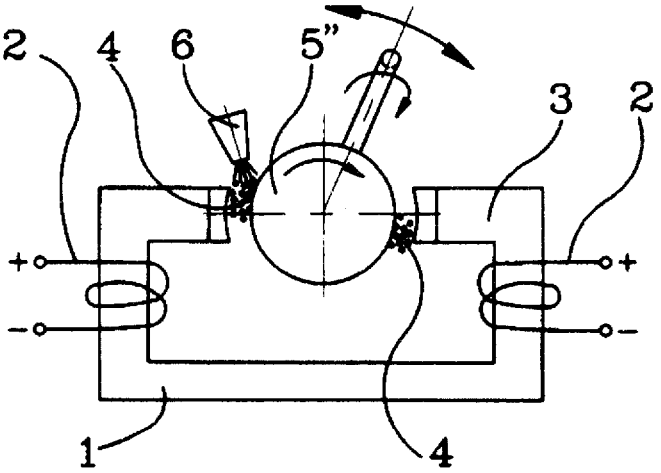

Finally, FIG. 8 shows a device for machining of a spherical part 5". The part 5" is arranged in the device corresponding to the device which is shown in FIG. 2. The part 5' is turnable about an axis which extends perpendicular to the plane of the drawings and also turnable in a plane which is perpendicular to the plane of the drawings so as to provide the machining of the spherical surface of the part.

Figure 9:
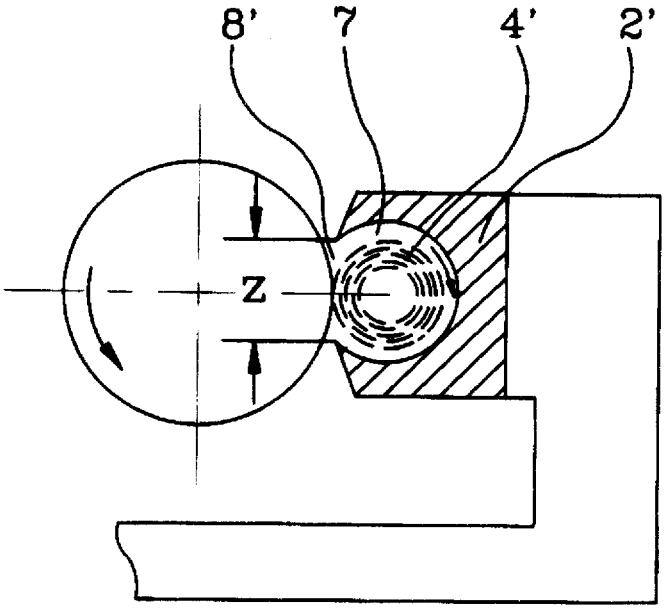
FIG. 9 is a view showing a further modification of the method and device in accordance with the present invention.
Figure 10:
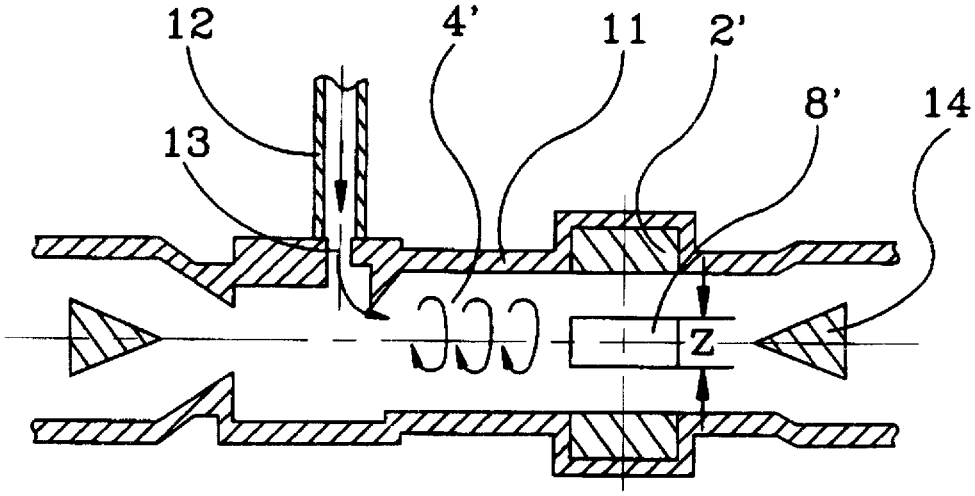
FIGS. 10 and 11 are views showing a source of a fluid jet supply for the device of FIG. 9.
Figure 11:
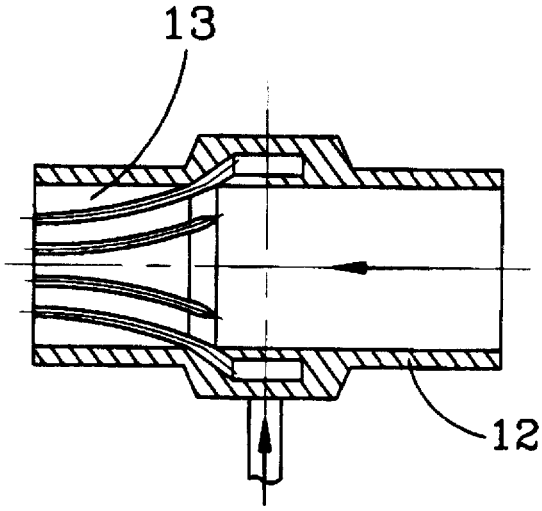

In accordance with another feature of the present invention, the fluid jet can be directed so that the magnetic-abrasive powder is moved with a high speed relative to the surface of the part so as to imitate a movement of a conventional material-removing, rigid tool relative to the part. This is shown for example in FIG. 9. Here, the pole shoe 2' has a substantially cylindrical inner chamber 7 with an open side 8. The magnetic-abrasive powder 4' is supplied so that it forms a worthex with the particles of the magnetic-abrasive powder rotatable in the chamber 7 at an exceptionally high speed. The thusly rotatable magnetic-abrasive powder imitates a rigid, rotatable abrasive tool, it contacts with a surface of the part and substantially increases the material-removal rate. The rotation of the magnetic-abrasive powder 4' can be performed by a fluid-jet source shown in FIG. 10 and 11. The sources formed as a tube 11 provided with a pipe 12 for a compress air supply and a nozzle 13 through air from generator is supplied to form a plurality of individual fluid jets. The resulting fluid jet 4' is rotatable with a speed. Control valves 14 are provided for oscillating the magnetic-abrasive powder in the chamber pole shoe by changing the direction and speed of the fluid jet in the axial direction of the vertex tube 11.

Figure 12:
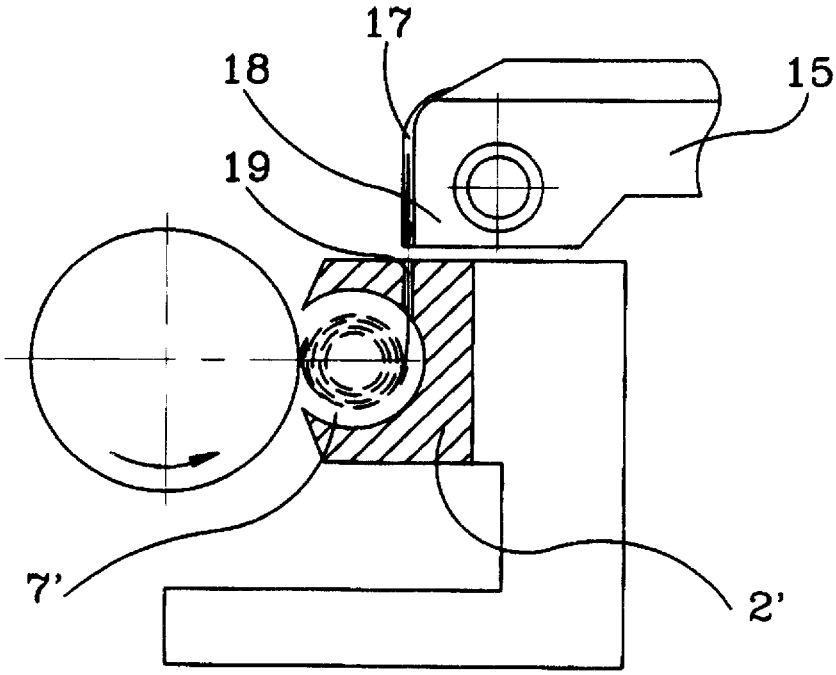
FIG. 12 is a view showing another source for the same purpose.

FIG. 12 shows a fluid-jet source 15 with a plenum chamber from which the compressed air is throttled through a thin nozzle 17. The thusly produced air stream adheres to a profile 18 and is directed into a slot 19 formed in the pole shoe 2'. The magnetic-abrasive powder rotates with a high speed inside a substantially cylindrical and radially open chamber 7' of the pole shoe. The magnetic field retains the magnetic-abrasive powder inside the chamber.

It is to be understood that the parameters of the method and the device shown in FIGS. 9–12 can be selected so that the magnetic-abrasive powder not only displaces relative to the surface of the part, but also is pressed toward the surface of the part. Also, the displacement of the magnetic-abrasive powder relative to the surface of the part can be performed not only by rotating the magnetic-abrasive powder, but also by displacing the magnetic-abrasive powder in accordance with other patterns relative to the surface of the part to be machined.

The details of the magnetic-abrasive machining of this type are disclosed in my U.S. Pat. No. 5,569,061 which is incorporated here by means of a reference.

It will be understood that each of the elements described above, or two or more together, may also find a useful application in other types of methods and constructions differing from the types described above.

While the invention has been illustrated and described as embodied in method and device for magnetic-abrasive machining of parts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of magnetic-abrasive machining of a part, comprising the steps of forming a magnetic field; arranging a part to be machined in the magnetic field; supplying a magnetic-abrasive powder in a machining zone toward a surface of the part to be machined; and supplying a fluid jet under pressure toward the magnetic-abrasive powder so as to move the magnetic-abrasive powder relative to the surface of the part to be machined.

2. A method as defined in claim 1, wherein said supplying a fluid jet includes supplying the fluid jet so that the fluid jet presses the magnetic-abrasive powder to against the surface of the part to be machined.

3. A method as defined in claim 1, wherein said supplying a fluid jet includes supplying the fluid jet so that the fluid jet displaces the magnetic-abrasive powder relative to the surface of the part to be machined.

4. A method as defined in claim 3, wherein said supplying a fluid jet includes supplying the fluid jet so that the fluid jet rotates the magnetic-abrasive powder relative to the surface of the part to be machined.

5. A method as defined in claim 1, wherein said supplying a fluid jet includes supplying the fluid jet so that the fluid jet presses the magnetic-abrasive powder to the surface of the part to be machined and at the same time displaces the magnetic-abrasive powder relative to the surface of the part to be machined.

6. A method as defined in claim 1, wherein said supplying a magnetic-abrasive powder includes accommodating the magnetic-abrasive powder in a temporary receptacle and attaching the temporary receptacle to said means for generating a magnetic field, so that thereafter the magnetic-abrasive powder leaves the receptacle to be supplied to the surface of the part machined.

7. A device for a magnetic-abrasive machining of a part, comprising means for generating a magnetic field; means for placing a part to be machined in the magnetic field; means for supplying a magnetic-abrasive powder into a machining zone onto a surface of the part to be machined; and means for supplying a fluid jet under pressure to the magnetic-abrasive powder so as to move the magnetic-abrasive powder relative to the surface of the part to be machined.

8. A device as defined in claim 7, wherein said means for supplying a magnetic-abrasive powder is formed so that the fluid jet presses the magnetic-abrasive powder to the surface of the part to be machined.

9. A device as defined in claim 7, wherein said means for supplying a magnetic-abrasive powder is formed so that the fluid jet displaces the magnetic-abrasive powder relative to the surface of the part to be machined.

10. A device as defined in claim 9, wherein said means for supplying a fluid jet is formed so that the fluid jet rotates the magnetic-abrasive powder relative to the surface of the part to be machined.

11. A device as defined in claim 7, wherein said means for supplying a fluid jet is formed so that the fluid jet presses the magnetic-abrasive powder to the surface of the part to be machined and at the same time displaces the magnetic-abrasive powder relative to the surface of the part to be machined.

12. A device as defined in claim 7, wherein said means for supplying a fluid jet includes means for accommodating the magnetic-abrasive powder in a temporary receptacle and attaching the temporary receptacle to said means for generating a magnetic field, so that thereafter the magnetic-abrasive powder leaves the receptacle to be supplied to the surface of the part machined.

* * * * *